United States Patent [19]

Koizumi

[11] Patent Number: 4,601,674

[45] Date of Patent: Jul. 22, 1986

[54] TOY MOTORCYCLE

[75] Inventor: Rikihachiro Koizumi, Narashino, Japan

[73] Assignee: Kabushiki Kaisha Hanzawa Corporation, Tokyo, Japan

[21] Appl. No.: 730,677

[22] Filed: May 3, 1985

[30] Foreign Application Priority Data

Apr. 15, 1985 [JP] Japan ..... 60-78565

[51] Int. Cl.[4] ..... A63H 00/00

[52] U.S. Cl. ..... 446/440; 446/462; 446/437

[58] Field of Search ..... 446/440, 431, 458, 462, 446/437

[56] References Cited

U.S. PATENT DOCUMENTS 2,697,306 12/1954 Muller ..... 446/440
3,677,156 6/1972 Tomiyama ..... 446/458
4,309,841 1/1982 Asano ..... 446/462
4,363,187 12/1982 Shinohara ..... 446/437

*Primary Examiner*—F. Barry Shay

[57] ABSTRACT

A toy motorcycle includes a body having a light-weight frame and a light-weight hood doubling as a cowling, a drive source, which also serves as a balancing weight, disposed at a lower position than the center of gravity of the toy inside the body, a rear wheel driven by the drive source through a power transmission system, and a plurality of projections formed on the body and on a front wheel support for facilitating self-righting of the toy. When the toy falls over due to collision with an obstacle while the toy is travelling on the ground, the projections come into contact with the ground and cause the rear wheel to contact the ground. The toy is righted to resume travelling by a righting function performed by the drive source and the driving function performed by the rear wheel.

6 Claims, 7 Drawing Figures

TOY MOTORCYCLE

BACKGROUND OF THE INVENTION

1. Field of the Invention

This invention relates to a toy motorcycle, particularly a toy motorcycle which, having fallen over due to collision with an obstacle while travelling, automatically rights itself and continues travelling.

2. Description of the Prior Art

Though a variety of toy motorcycles have heretofore been proposed and made available, almost all of them are incapable of continuing travelling once they have fallen over upon colliding with an obstacle while running. In particular, conventional toy motorcycles that run at high speeds cannot right themselves and resume travelling once they have fallen over. More specifically, a self-righting toy wheel is known which, having fallen over, rights itself providing that it remains in contact with the ground. With an ordinary toy motorcycle, however, the wheels in many cases lose contact with the ground by falling over upon collision with an obstable. A running toy capable of repeatedly turning over and making lateral turns is also known. However, the latter is a four-wheel toy automobile having a guide frame and levers projecting from the car body. Such an arrangement cannot be adapted to a toy motorcycle to right the motorcycle and allow it to resume running following a collision with an obstacle.

SUMMARY OF THE INVENTION

An object of the present invention is to provide a toy motorcycle capable of offering greater enjoyment by automatically righting itself and continuing travelling upon having fallen over due to collision with an obstacle while travelling.

Another object of the present invention is to provide a toy motorcycle capable of righting itself and of continuing travelling upon having fallen over, this being achieved through a simple construction of an attractive design which does not result in a toy motorcycle of an unnatural appearance.

Still another object of the present invention is to provide a toy motorcycle capable of running in a stable manner without tilting or wobbling from side to side during ordinary travel.

According to the present invention, the foregoing objects are attained by providing a toy motorcycle including a drive source, which also serves as a balancing weight, disposed at a lower position of the toy centroid inside a body having a frame made of a light-weight material and a hood, which doubles as a cowling, made of a light-weight material, a rear wheel driven by the drive source through a power transmission system, and a plurality of projections formed on peripheral portions of the body and of a front wheel support for facilitating self-righting of the toy. When the toy falls over due to collision with an obstacle while the toy is travelling along the ground, the projections come into contact with the ground, thereby bringing the rear wheel into contact with the ground. The toy is righted to resume travelling by a righting function performed by position of the drive source and by the driving function performed by the rear wheel.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
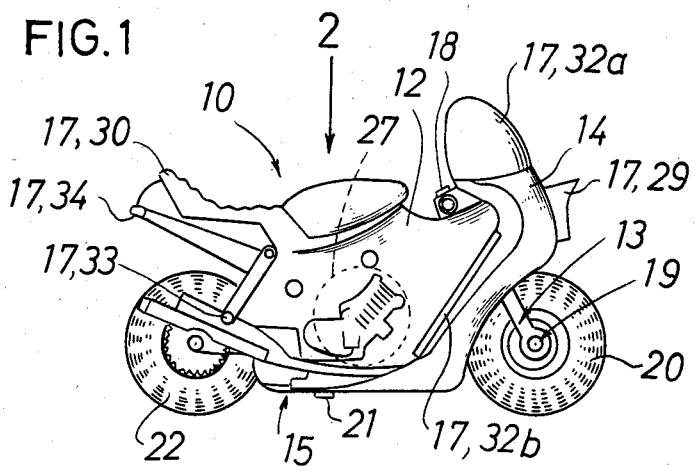
FIG. 1 is a side view illustrating an embodiment of a toy motorcycle according to the present invention.
Figure 2:
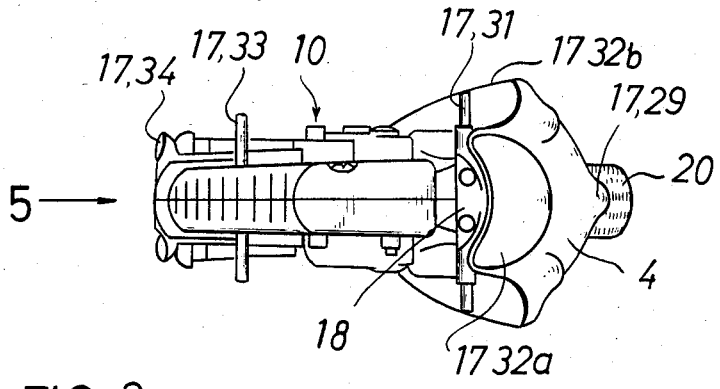
FIG. 2 is a plan view of the toy motorcycle as viewed along the arrow 2 in FIG. 1.
Figure 3:
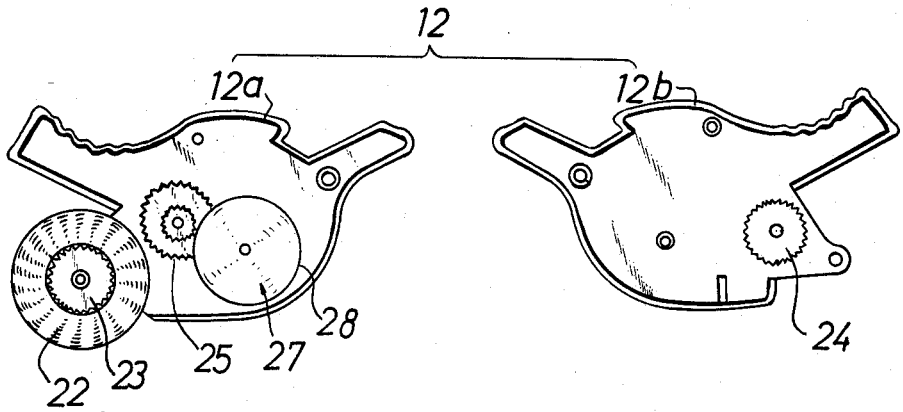
FIG. 3 is a side view of left and right halves of the motorcycle body and shows a drive source as well as a power transmission system.
Figure 4:
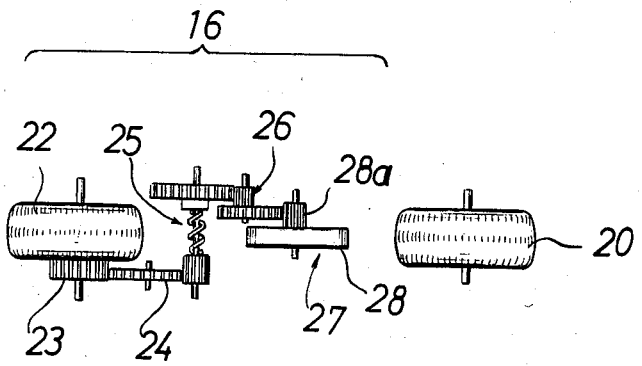
FIG. 4 is a plan view showing the drive source and the power transmission system in greater detail.

As shown in FIGS. 1 and 2, a preferred embodiment of a toy motorcycle 10 according to the present invention has a body 15 essentially comprising a frame 12 and a hood 14 serving also as a cowling. As shown in FIG. 3, the frame 12 is split longitudinally thereof into left and right synthetic resin-molded parts 12*a*, 12*b* joined edge-to-edge to form the frame. Retained between the joined parts 12*a*, 12*b* at the front end of the motorcycle 10 is a front wheel support 13 capable of being turned from side to side. The front wheel support 13 comprises a handle 18 at one end and a front fork 19 formed at the other end integrated with the handle. The front fork 19 axially supports at its distal end a front wheel 20 capable of being rotated about the axle thereof. The hood 14, doubling as the cowling, is secured to the front end of the frame 12 and is a molded part consisting of a synthetic resin. The synthetic resin material constituting the frame 12 and the hood 14, which in turn are the principal components that form the body 15, renders the body 15 light in weight. The body 15 internally accommodates the major portion of a power transmission system 16 as well as a drive source 27.

As shown in FIGS. 1 through 4, a rear wheel 22, which is the driving wheel of the motorcycle 10, is axially supported for rotation at the rear of the frame 12. A gear 23 integral with the rear wheel 22, an intermediate gear 24 and first and second speed-up gears 25, 26, respectively, construct the power transmission system 16. The drive source 27 doubles as a balancing weight such as a flywheel 28, which is provided with a coaxial gear 28*a* meshing with the second speed-up gear 26. The driving source 27 serving also as the balancing weight is disposed at a position lower than the centroid of the toy motorcycle 10 and constantly acts to restore the body 15 to an upright attitude when the body tilts to the left or right of the direction of travel. It should be noted that a spiral spring may be substituted for the flywheel 28 so long as the spring also functions as a balancing weight.

The body 15 has projecting portions 17 for promoting the self-righting ability of the toy motorcycle 10, these being constituted by a headlight 29 projecting from the front of the body 15, a seat 30 projecting from the rear, a turn signal 34, handle grip 31, hood portion 32*b* and step bar 33 projecting from the right and left, and a cowling portion 32*a* projecting from the top. The projecting portions 17, acting individually or in concert, facilitate the righting of the body 15 when the toy motorcycle falls over. The front and rear wheels 20, 22 extending forwardly and rearwardly of the body 15 also cooperate with the projecting portions 17 to promote the righting of the toy.

Figure 5:
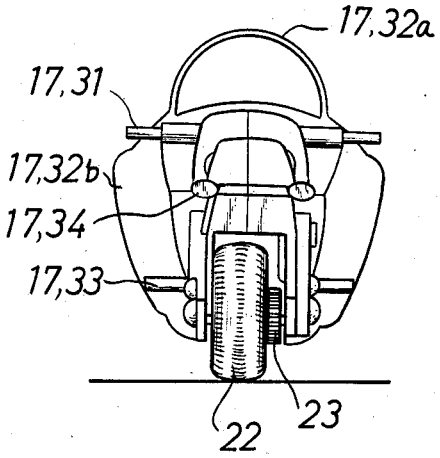
FIGS. 5, 6 and 7 are back views of the toy motorcycle, as viewed along the arrow 5 in FIG. 2, showing the toy motorcycle when travelling in an upright attitude, when travelling at a moderate angle of inclination, and when travelling at a sharp angle of inclination, respectively.
Figure 6:
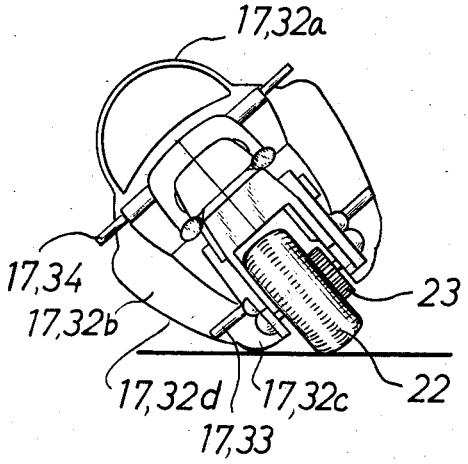
Figure 7:
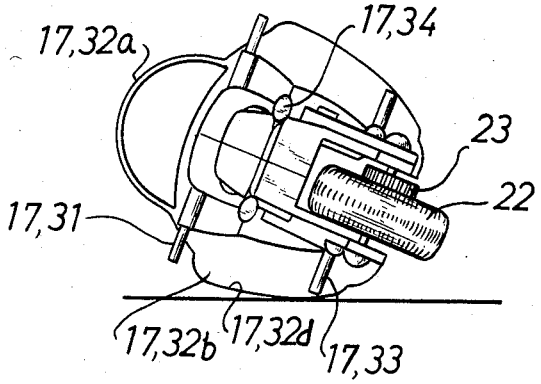

In use, an individual playing with the toy motorcycle 10 grasps the body 15 and rotates the rear wheel 22 while bringing the rear wheel into contact with the ground. The rotational motion of the rear wheel 22 is transmitted to the flywheel 28 through the power transmission system 16, as a result of which the flywheel 28 is caused to rotate at an increasing rate of speed. When the flywheel 28 attains a sufficient rotational speed, the body 15 is released by the user with its front and rear wheels 20, 22 in contact with the ground. The toy 10 will then run along the ground in the attitude shown in FIG. 5 owing to the angular momentum of the flywheel 28 transmitted to the rear wheel 20 through the power transmission system 16. Since the drive source 27 doubles as a balancing weight which is disposed at a position lower than the centroid of the toy 10, and since the body 15 of the toy 10 is made of a light-weight material, the toy 10 will travel in a stable manner without tilting from side to side, even at low speed, under ordinary conditions. If the toy 10 collides with an obstacle and falls over to the right or left, a lower region 32*c* and a side region 32*d* of the hood portion 32*b* constituting the hood 14 contact the ground, as shown in FIGS. 6 and 7. Also, depending upon the manner in which the toy 10 falls over, the step bar 33 and the handle grip 31, or the turn signal 34 and the cowling portion 32*a* come into contact with the ground as well. These portions, by acting as the aforementioned projecting portions 17 that promote the righting of the toy by utilizing the shock sustained when the toy falls over, cause the rear wheel 22 to come into contact with the ground. When this occurs, the toy 10 is automatically righted and set into motion again by the righting function, or more specifically the balancing function, of the flywheel 28 and by the driving function of the rear wheel 22.

Since the portions 17 that project from the periphery of the toy 10 to facilitate the righting of the toy are provided at points where such projections would naturally exist according to the shape of a motorcycle, the toy has an outstanding design and is simple in construction because special projections need not be provided.

As many apparently widely different embodiments of the present invention can be made without departing from the spirit and scope thereof, it is to be understood that the invention is not limited to the specific embodiments thereof except as defined in the appended claims.

What we claim is:

1. A toy motorcycle comprising:

a body having a frame and a hood doubling as a cowling, said frame and said hood being made of a light-weight material;

a freely rotatable front wheel supported at a front portion of said body by a front wheel support;

a rear wheel supported for rotation at a rear portion of said body for driving said toy;

a drive source doubling as a balancing weight disposed interiorly of said body at a lower position than the center of gravity of the toy for applying driving power to said rear wheel and for righting the toy when said toy falls over due to collision with an obstacle while said toy is travelling on the ground;

a power transmission system coupling said drive source with said rear wheel; and means including a plurality of projections formed on peripheral portions of said body and of said front wheel support for facilitating self-righting of the toy;

wherein when the toy falls over due to collision with an obstacle while the toy is travelling along the ground, said projections come into contact with the ground to bring said rear wheel into contact with the ground and said toy is righted to resume travelling by the righting function of said drive source and the driving function of said rear wheel.

2. The toy motorcycle according to claim 1, wherein said frame is split longitudinally thereof into a pair of parts joined securely together edge to edge, and said hood is secured to a front end portion of said frame.

3. The toy motorcycle according to claim 2, wherein said parts and said hood are molded from synthetic resin.

4. The toy motorcycle according to claim 1, wherein said front wheel support has a handle and a front fork, said front fork axially supporting said front wheel.

5. The toy motorcycle according to claim 1, wherein said drive source is a flywheel.

6. The toy motorcycle according to claim 1, wherein said projections form a headlight projecting forwardly of said body, a seat projecting rearwardly of said body, a turn signal, a handle grip, a hood portion and a step bar each of which projects transversely of said body, and a cowling projecting upwardly of said body.

* * * * *